US005102476A

United States Patent [19]

Wahl

[11] Patent Number: 5,102,476

[45] Date of Patent: Apr. 7, 1992

[54] PROCESS FOR NITROCARBURIZING COMPONENTS MADE FROM STEEL

[75] Inventor: Georg Wahl, Rodenbach, Fed. Rep. of Germany

[73] Assignee: Degussa Aktiengesellschaft, Frankfurt am Main, Fed. Rep. of Germany

[21] Appl. No.: 592,445

[22] Filed: Oct. 1, 1990

[30] Foreign Application Priority Data

Oct. 4, 1989 [DE] Fed. Rep. of Germany ..... 3933053

[51] Int. Cl.[5] ..... C23C 9/00

[52] U.S. Cl. ..... 148/15.5; 148/15; 148/20; 148/28

[58] Field of Search ..... 148/15, 15.5, 20, 27, 148/28

[56] References Cited

U.S. PATENT DOCUMENTS 1,893,077 1/1933 Garweg ..... 148/28

FOREIGN PATENT DOCUMENTS 45-31731 10/1970 Japan .

1185640 3/1970 United Kingdom ..... 148/15.5

*Primary Examiner*—H. Dean

*Assistant Examiner*—Sikyin Ip.

*Attorney, Agent, or Firm*—Beveridge, DeGrandi & Weilacher

[57] ABSTRACT

Components made from steel can be nitrocarburized in cyanate- and cyanide-containing salt baths within relatively short times if the process is carried out at 600° to 700° C. in a first stage and at 560° to 590° C. in a second stage. The components exhibit the same or better characteristics as compared to considerably longer processing at 560° to 590° C.

2 Claims, 1 Drawing Sheet

PROCESS FOR NITROCARBURIZING COMPONENTS MADE FROM STEEL

INTRODUCTION TO THE INVENTION

The present invention relates to a process for nitrocarburizing components made from steel in cyanate- and cyanide-containing salt melts at temperatures between 560° to 700° C. Of particular interest is the application of the process to structural elements.

For nitrocarburizing parts made from iron and steel use is made predominantly of salt melts consisting of mixtures of alkaline cyanides, alkaline cyanates and alkaline carbonates. These melts are generally maintained at temperatures between 560° and 590° C. Such salt baths are known, for instance, from DE-PS 1 149 035. However, there are also nitrocarburizing salt baths in which processing takes place at higher temperatures up to 700° C.

The workpieces are subjected for some time to the action of the salt melt, whereby nitrogen and carbon are diffused into the workpieces and iron carbon nitride phases are formed within the surface layers. The presence of these phases increases the wear resistance and corrosion resistance of the structural components. The nitrogen and carbon available in the salt melt, the processing temperature, and the processing time all influence the structure, the thickness, and the quality of the nitrocarburized layer in the steel.

If the nitrocarburizing process is carried out in the cyanate- and cyanide-containing salt baths, for instance at 580° C., components are produced which exhibit a corrosion resistance that is not very good. This is due to the formation of a monophase layer of E-iron carbonitride. At 580° C., however, relatively long periods of time, as a rule several hours, are required for a layer of adequate thickness and quality to form.

At higher temperatures, for instance at 630° C., E-layers of iron carbonitride of appropriate thickness are produced more quickly. However, the wear resistance and the corrosion resistance of the components thus processed is definitely lower than with components processed at 580° C. in identical salt melts.

SUMMARY OF THE INVENTION

An object of the present invention is to provide a process for nitrocarburizing components made from steel in cyanate- and cyanide-containing salt melts at temperatures between 560° and 700° C., so as to ensure that the components exhibit good wear and corrosion characteristics after a minimum processing time.

According to the present invention, this and other objects are achieved by carrying out the nitrocarburizing process in a first stage at 600° to 700° C. and in a second stage at 560° to 590° C., wherein the nitrocarburizing times of the two stages falls within a range from 20:1 to 1:15. The components are made at least in part of steel and are immersed into the melt.

With a preferred method, the process is carried out in the first stage at 610° to 650° C. during a period of 10 to 120 minutes, and in the second stage at 570° to 590° C. during a period of 10 to 90 minutes. The composition of said melts is conventional.

With this two-stage process an adequately thick interface is achieved, whereby, surprisingly, said interface possesses the same characteristics as an interface formed during considerably longer periods of time at temperatures from 560° to 590° C. It is possible, as a result, to reduce the nitrocarburizing time considerably without impairing the quality of the components processed as regards wear, corrosion, fatigue strength etc.

DETAILED DESCRIPTION OF THE INVENTION

Figure 1:
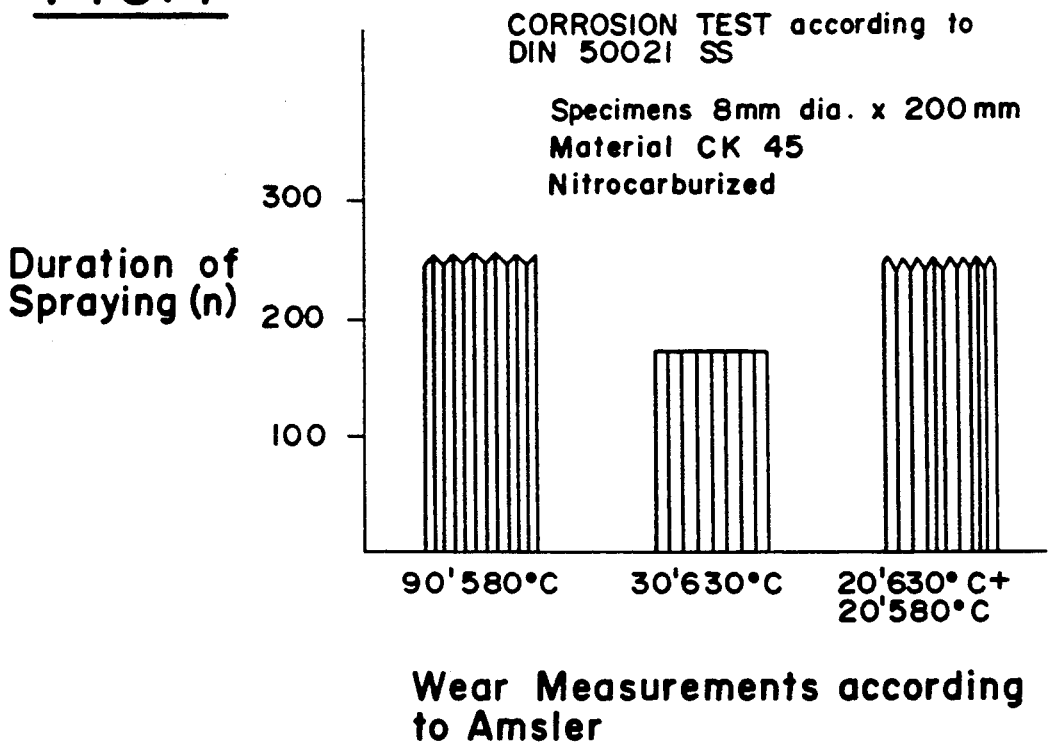
FIGS. 1 and 2 illustrate by way of graphs the corrosion characteristics (FIG. 1) and the wear resistance (FIG. 2) of specimens made from steel CK 45 after processing, at different temperatures, in a salt melt containing 2.8 wt % cyanide and 37.4 wt. % cyanate.

FIG. 1 compares the corrosion resistance of cylindrical specimens after nitrocarburizing. In all cases the process was carried out in such a way as to achieve an interface of about 15 μm thickness. The column on the left shows the corrosion resistance of piston rods nitrocarburized for 90 minutes at 580° C. The column in the middle shows the resistance of the components after nitrocarburizing for 30 minutes at 630° C. The column on the right shows the resistance of specimens nitrocarburized initially for 20 minutes at 630° C. and subsequently for 20 minutes at 580° C.

Figure 2:
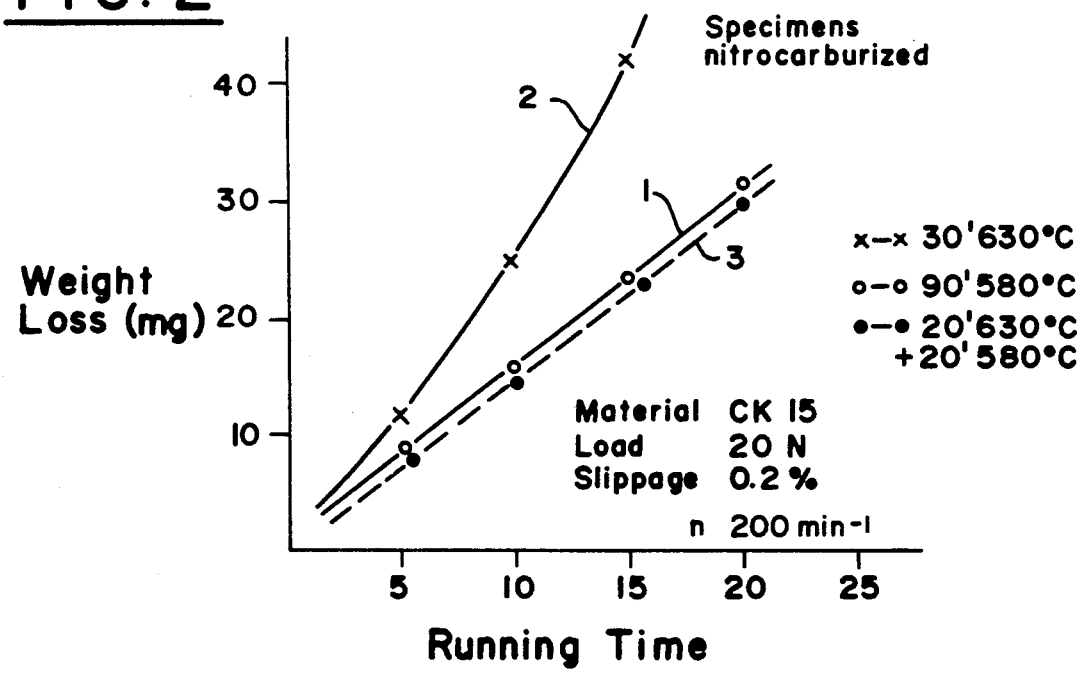

The wear characteristic were also favorably affected by the two-stage process according to the invention. The result of an Amsler test is shown in FIG. 2. Curve 1 corresponds to the normal processing, for 90 minutes at 580° C., of specimens made from the material C45. Curve 2 relates to specimens nitrocarburized for 30 minutes at 630° C. Curve 3 shows the result of two-stage nitrocarburizing for 20 minutes at 630° C. and for 20 minutes at 580° C. The wear characteristics of a component processed for 20 minutes at 630° C. and then for 20 minutes at 180° C. are therefore comparable with those of a component nitrocarburized for 90 minutes at 580° C. It follows that the process according to the present invention reduces the processing time by more than half.

Further variations and modifications of the invention will become apparent to those skilled in the art from the foregoing and are intended to be encompassed by the claims appended hereto.

German Priority Application P 39 33 0522 is relied on and incorporated by reference.

I claim:

1. A process for nitrocarburizing a component made at least in part from steel in a cyanate- and cyanide-containing salt melt at a temperature between 560° and 700° C., comprising immersing said component in said melt in a first stage at 600° to 700° C., and in a second stage at 560° to 590° C., wherein the ratio of time of immersion in said first stage:time of immersion in said second stage is from 20:1 to 1:15.

2. A process for nitrocarburizing a component made at least in part from steel in a cyanate- and cyanide-containing salt melt at a temperature between 560° and 700° C., comprising immersing said component in said melt in a first stage at 610° to 650° C. for 10 to 120 minutes and in a second stage at 570° to 590° C. for 10 to 90 minutes.

* * * * *